United States Patent [19]

Schmitz

[11] Patent Number: 4,850,948

[45] Date of Patent: Jul. 25, 1989

[54] APPARATUS AND METHOD FOR PRODUCTION OF PACKAGE INSERT

[75] Inventor: Ronald F. Schmitz, Kulpmont, Pa.

[73] Assignee: Four M Corporation, Thornwood, N.Y.

[21] Appl. No.: 251,852

[22] Filed: Oct. 3, 1988

Related U.S. Application Data

[62] Division of Ser. No. 171,128, Mar. 21, 1988.

[51] Int. Cl.[4] ..... B31B 7/02; B31B 11/04; B31B 7/94; B31B 11/98

[52] U.S. Cl. ..... 493/379; 493/89; 493/90; 493/110; 493/391; 156/288; 156/291; 156/548; 271/9; 271/309

[58] Field of Search ..... 156/288, 291, 297, 299, 156/381, 548; 271/3.1, 9, 207, 309; 493/89, 90, 91, 92, 110, 120, 141, 379, 391

[56] References Cited

U.S. PATENT DOCUMENTS

| | | | |
|---|---|---|---|
| 2,015,202 | 9/1935 | Stokes | 493/110 |
| 2,046,985 | 7/1936 | Wilkins | 93/37 |
| 2,384,768 | 9/1945 | Rau | 271/9 |
| 2,391,230 | 12/1945 | Dickerman | 93/37 |
| 2,579,094 | 12/1951 | Rooksby | 271/9 |
| 2,593,092 | 4/1952 | Bergstein | 229/42 |
| 2,620,118 | 12/1952 | Lillie | 229/42 |
| 2,645,480 | 7/1953 | Long | 271/207 |
| 2,995,291 | 8/1961 | Swanson et al. | 229/42 |
| 3,201,022 | 8/1965 | Glassco et al. | 229/15 |
| 3,403,835 | 10/1968 | Schwaner | 229/15 |
| 3,412,920 | 11/1968 | Desforges | 229/15 |
| 3,425,615 | 2/1969 | Wood | 229/15 |
| 3,515,036 | 6/1970 | Oki et al. | 93/1 |
| 3,580,471 | 5/1971 | Burke et al. | 229/15 |
| 3,725,183 | 4/1973 | Brookhyser et al. | 156/299 |
| 3,770,184 | 11/1973 | Rockefeller | 229/15 |
| 3,964,953 | 6/1976 | Mitchard et al. | 271/9 |
| 3,984,046 | 10/1976 | McMahon | 229/28 R |
| 3,985,286 | 10/1976 | Hicks | 229/15 |
| 4,040,558 | 8/1977 | Bamburg et al. | 229/23 BT |
| 4,096,984 | 6/1978 | Gardner | 229/15 |
| 4,130,235 | 12/1978 | Killy | 229/15 |
| 4,272,008 | 6/1981 | Wozniacki | 229/15 |
| 4,282,999 | 8/1981 | Moen | 229/15 |
| 4,304,354 | 12/1981 | Shermer | 229/42 |
| 4,335,842 | 6/1982 | Bradford et al. | 229/15 |
| 4,351,471 | 9/1982 | Dunkle | 229/15 |
| 4,371,109 | 2/1983 | Tanner et al. | 229/28 R |
| 4,581,005 | 4/1986 | Moen | 493/89 |
| 4,601,687 | 7/1986 | Gallaher | 493/89 |
| 4,643,414 | 2/1987 | Weisgerber | 271/309 |

FOREIGN PATENT DOCUMENTS

| | | | |
|---|---|---|---|
| 72730 | 4/1951 | Denmark | 229/120.31 |
| 1395153 | 3/1965 | France | 229/120.31 |

*Primary Examiner*—Frederick R. Schmidt
*Assistant Examiner*—William E. Terrell
*Attorney, Agent, or Firm*—Jeffrey H. Ingerman

[57] ABSTRACT

A laminated package insert is provided having increased compressive strength for a given weight of board stock, and being easier to erect, as compared to previously known inserts. The insert is made from two substantially identical blanks, with identical score patterns, placed face-to-face and adhered in selected areas, leaving other areas adhesive-free. The score lines are formed so that no score line has to be broken backwards during erection, thereby making erection easier, particularly for automatic insert erecting equipment. A method and apparatus for assembling the insert are also provided wherein two feeders alternately feed blanks into a hopper, each successive pair of blanks being face-to-face, one blank having adhesive on selected areas of the face facing the other blank. The synchronization of the two feeders is carefully controlled, as is the settling of the blanks in the hopper, using air jets free of turbulence.

21 Claims, 10 Drawing Sheets

APPARATUS AND METHOD FOR PRODUCTION OF PACKAGE INSERT

CROSS-REFERENCE TO RELATED APPLICATION

This application is a division of copending, commonly-assigned U.S. patent application Ser. No. 07/171,128, filed Mar. 21, 1988.

BACKGROUND OF THE INVENTION

This invention relates to package inserts. More particularly, this invention relates to a laminated package insert produced by adhering two identical blanks face-to-face.

In packaging, and particularly in corrugated paperboard packaging, inserts are used in packages to divide the package into compartments and, more significantly, to provide vertical compressive strength or "stack strength". Originally, these inserts were single-walled pieces interlocked with slits in other pieces, such as in the familiar "egg crate" insert, or folded and glued into a desired shape, and placed in the package with their principal planes parallel to the direction of compression of the package. Additional compressive strength was obtained by using additional pieces in the insert. However, that had the effect of further reducing the available volume inside the package, as each piece occupied part of the package interior. It also resulted in smaller compartments in the package, restricting the types of articles that could be packed in a particular size of package. Compressive strength could also be increased by using heavier material, such as heavier paperboard, for the inserts. However, the heavier material is thicker and therefore also occupies additional volume.

Later, it was found that strength could be gained by forming inserts from multiple layers—e.g., two layers—by folding a layer of material on itself before folding it to form the insert. Once this was done, it was realized that by properly scoring, cutting and, if desired, selectively glueing, the folded-over insert, a single multiple layer insert in which the layers were adhered only in selected areas could be erected into a multiple compartment structure.

It is known to form such inserts from a single blank which is scored with a desired score pattern and then folded on itself to provide a two-layer structure which may then be selectively adhered, if desired. However, such blanks are typically scored using die-cutting techniques, in which only one side of the bank can be scored. Therefore, some scores in the blank are intended to be broken backwards, i.e., to be folded against their natural folding direction, resulting in frequent poor fold lines when such inserts are erected. In addition, it is more difficult for automatic insert erection equipment to erect an insert when it has to break score lines backwards. Although one such insert is known in which the scoring is done using slotter-scorer type apparatus, allowing the score lines to be formed from both sides of the blank, that insert was not glued together once folded because it was believed that such glueing would weaken the insert if the blank was not perfectly folded and aligned when glued. In addition, if an insert is formed from a folded blank, and then placed in the package such that the compressive forces are directed against the radius of the fold, the insert tends to buckle at the fold.

It would be desirable to be able to provide a multiple layer insert which can be erected easily by hand or by automatic insert erecting machinery and is stronger than previous multiple layer inserts for the same grade of board stock.

It would also be desirable to be able to provide a method and apparatus for forming the insert.

SUMMARY OF THE INVENTION

It is an object of this invention to provide a multiple layer insert which can be erected easily by hand or by automatic insert erecting machinery and is stronger than previous multiple layer inserts for the same grade of board stock.

It is also an object of this invention to provide a method and apparatus for forming the insert.

In accordance with this invention, there is provided a laminated package insert of a self-supporting, scorable, foldable material, providing compressive strength in a desired direction to a package in which it is inserted. The insert comprises first and second blanks of said material. The blanks are substantially identical, each of the blanks having first and second faces and having a score pattern on at least one of the faces. One of the first and second faces of the first blank is adhered to a corresponding one of the first and second faces of the second blank by at least one area of adhesive extending substantially from a first end of each of the blanks to a second end of each of the blanks in the desired direction. The at least one area extends over less than the full extent of each blank in a direction normal to the desired direction, leaving at least one adhesive-free area. The insert can be erected by folding the adhered blanks in accordance with the score pattern, with the first and second blanks separating in at least one adhesive-free area, but remaining adhered on the at least one area of adhesive, upon erection of the insert.

Apparatus for forming a laminated package insert from two substantially identical blanks, each of said blanks having a substantially identical score pattern, by adhesively assembling one of a first and second face of one of said blanks to the corresponding one of a first and second face of the other of the blanks, the insert being for providing compressive strength in a desired direction to a package in which it is inserted, is provided. The apparatus comprises a receiving hopper for receiving said blanks with their corresponding faces adjacent one another, first feeding means on a first side of the receiving hopper for feeding one of the blanks into the receiving hopper with one of the first and second faces up. Second feeding means on a second side of the receiving hopper directly opposite the first feeding means feeds the other of the blanks into the receiving hopper with a corresponding one of the first and second faces down. Adhesive-applying means associated with one of the first and second feeding means applies adhesive to at least one selected area of that one of the first and second faces of that one of the blanks fed by the feeding means, the at least one selected area extending substantially from a first end of each of the blanks to a second end of each of the blanks in the desired direction, the at least one area extending over less than the full extent of each of the blanks in a direction normal to the desired direction, leaving at least one adhesive-free area, before feeding that one of the blanks to the receiving hopper. Synchronization means interconnecting the first and second feeding means controls the feeding of the blanks to the receiving hopper such that the first and second feeding means alternately feed blanks at the same feed rate to the receiving hopper. Settling controlling means associated with the receiving hopper cause each of the blanks to settle in the receiving hopper, without excessive float and without turbulence, at a settling rate sufficient to prevent collision between blanks fed by the first feeding means and blanks fed by the second feeding means, such that each of the blanks to which adhesive has been applied by the adhesive applying means adheres in the receiving hopper to an adjacent blank which is free of adhesive to form the laminated package insert. Take-away means removes the inserts from the receiving hopper.

Each of the inserts made using the apparatus can be erected by folding the adhered blanks in accordance with the score pattern, the first and second blanks separating in at least one adhesive-free area, but remaining adhered in the at least one area of adhesive, upon erection of the insert.

A method for forming the inserts is also provided.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
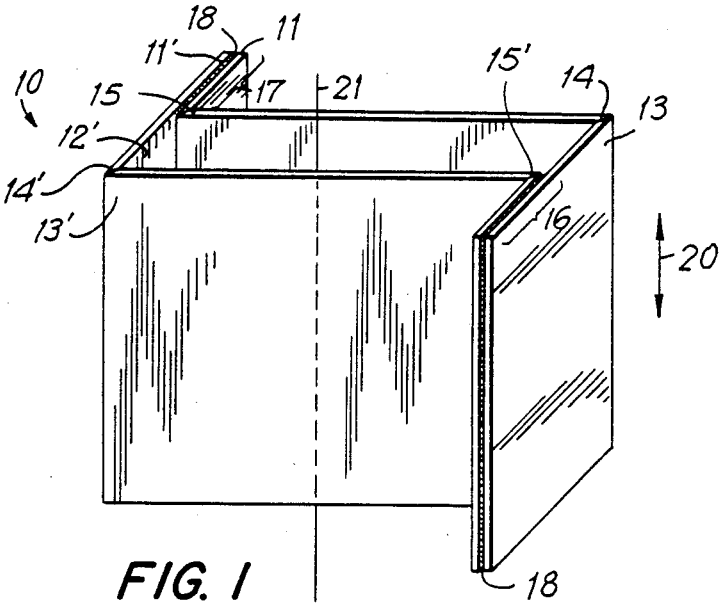
FIG. 1 is a perspective view of one configuration of package insert according to this invention in an erected condition.

A preferred embodiment of a laminated package insert according to the present invention is shown in FIGS. 1–4. The insert shown is of a configuration known in the art as a "Double-Z" because of its appearance in plan view when erected. Insert 10 is made from two substantially identical blanks 11, 11'. Blanks 11, 11' are of a self-supporting, scorable, foldable material, preferably corrugated paperboard, and have corresponding first faces 12, 12' and second faces 13, 13'. Both blanks 11, 11' also have substantially identical score patterns, with score lines 14, 14' in first faces 12, 12' and score lines 15, 15' in second faces 13, 13'. Score lines 14, 14', 15, 15' are most preferably perforated score lines for ease of folding, but could also be ordinary score lines or slit-score lines.

Blanks 11, 11' are assembled into insert 10 with corresponding faces—in this case first faces 12, 12'—adjacent one another. Blanks 11, 11' are adhered to one another by bands or areas 16, 17 of adhesive 18, preferably a cold-set adhesive, leaving adhesive-free area 19. As shown in FIGS. 1–4, adhesive areas 16, 17 completely cover the areas of blanks 11, 11' that remain in contact when insert 10 is erected (as discussed below). However, depending on the amount of strength needed, it may not be necessary to cover those entire areas, although for proper folding of the score lines, there should be adhesive immediately adjacent any score line that remains adjacent the other of blanks 11, 11' even after erection.

Figure 2:
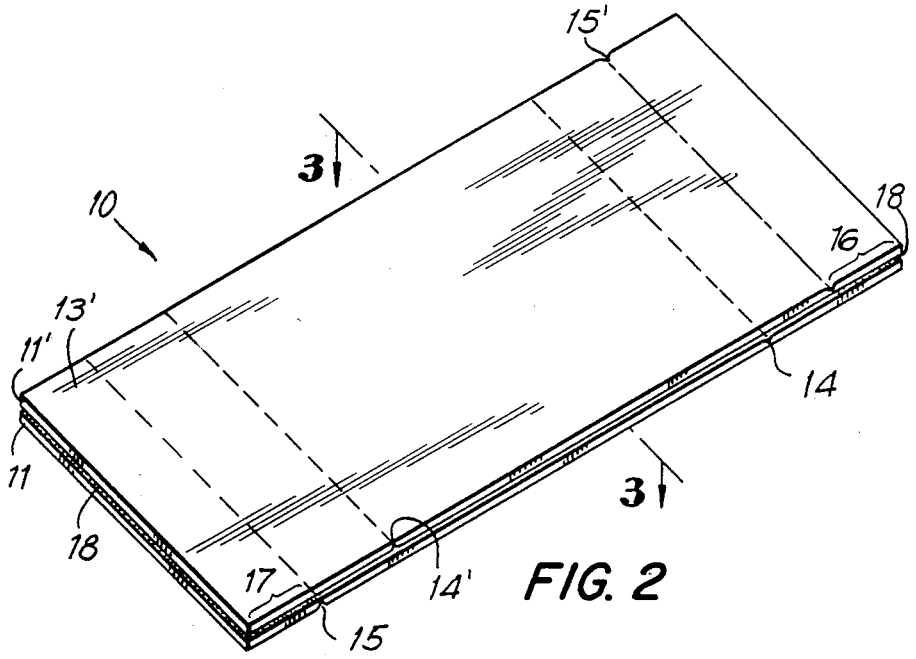
FIG. 2 is a perspective view of the insert of FIG. 1 in an unerected condition.
Figure 3:
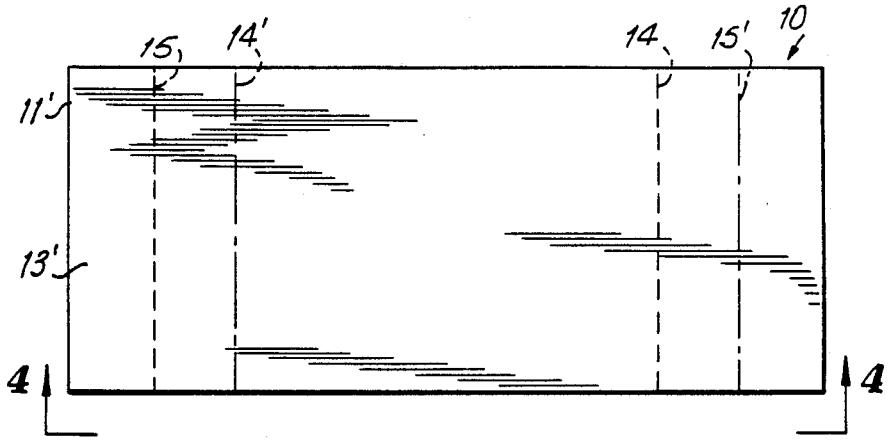
FIG. 3 is a plan view of the unerected insert of FIG. 2, taken from line 3—3 of FIG. 2.
Figure 4:
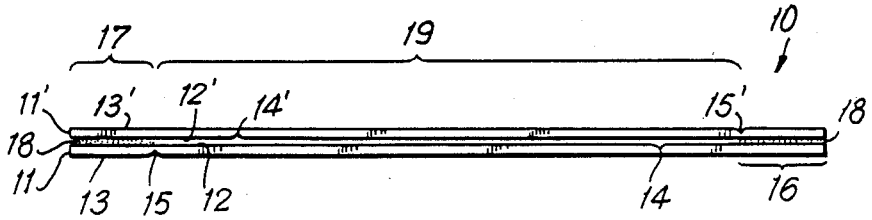
FIG. 4 is an elevational view of the unerected insert of FIG. 2, taken from line 4—4 of FIG. 3.
Figure 5A:
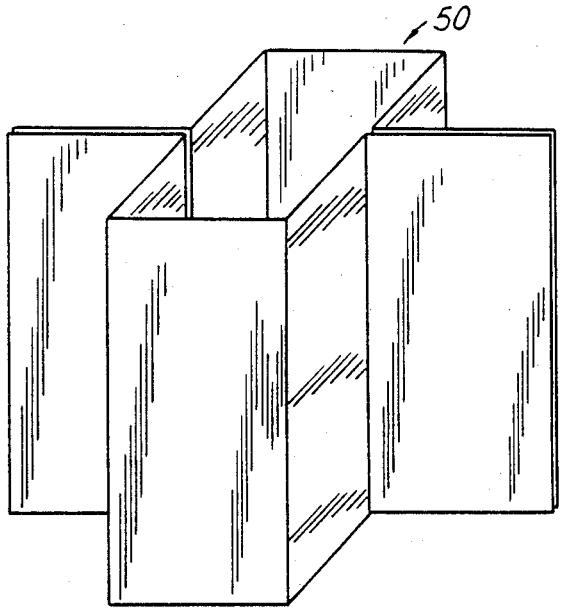
FIGS. 5A–5E are schematic perspective views of other configurations of package inserts according to this invention.
Figure 5B:
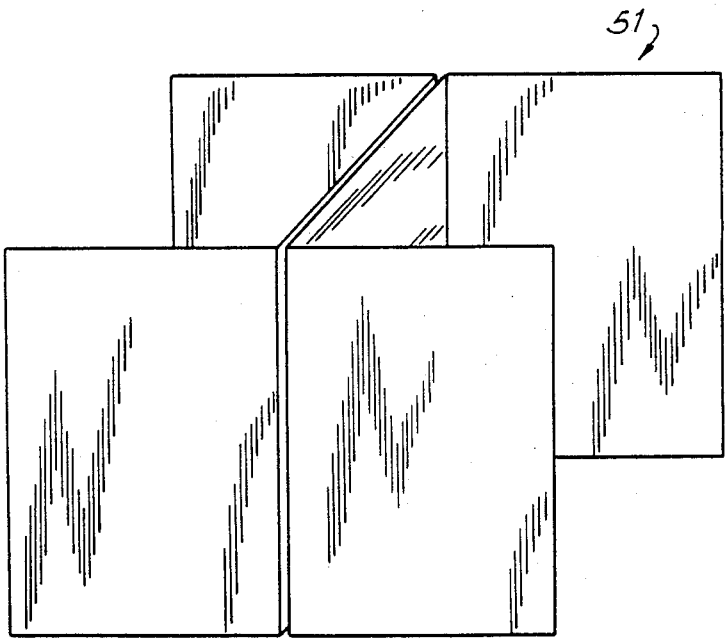
Figure 5C:
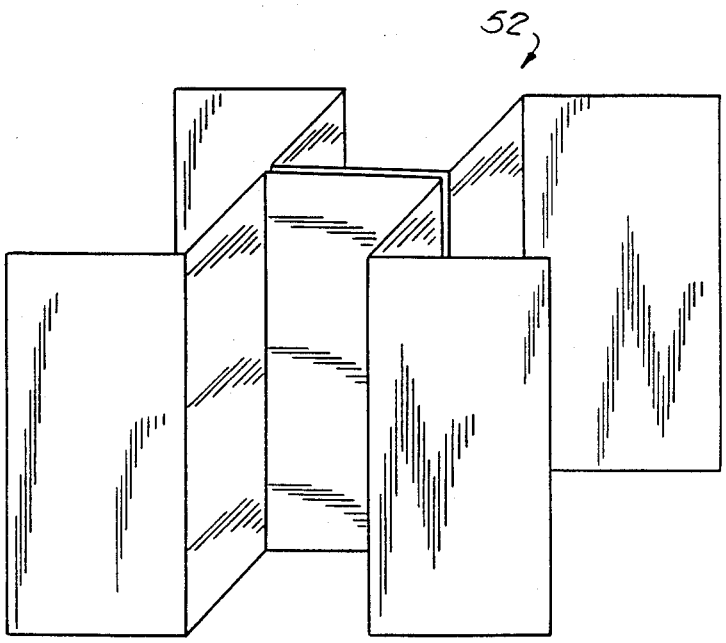
Figure 5D:
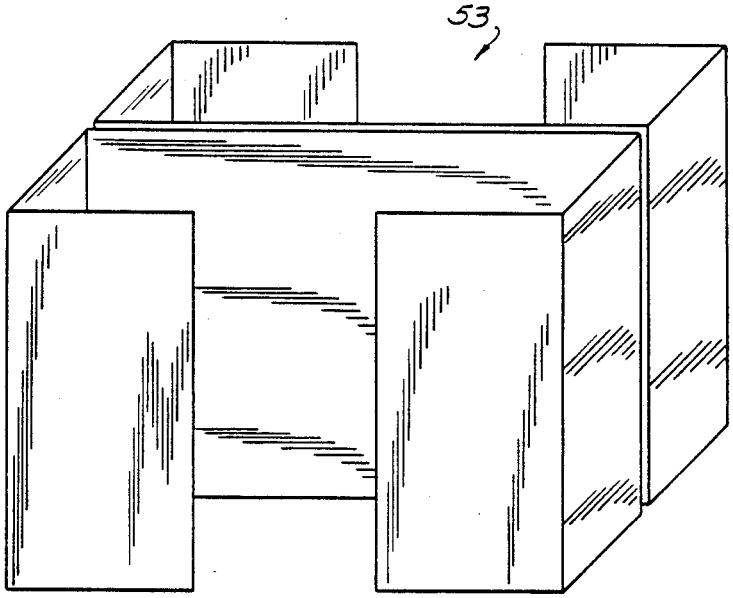
Figure 5E:
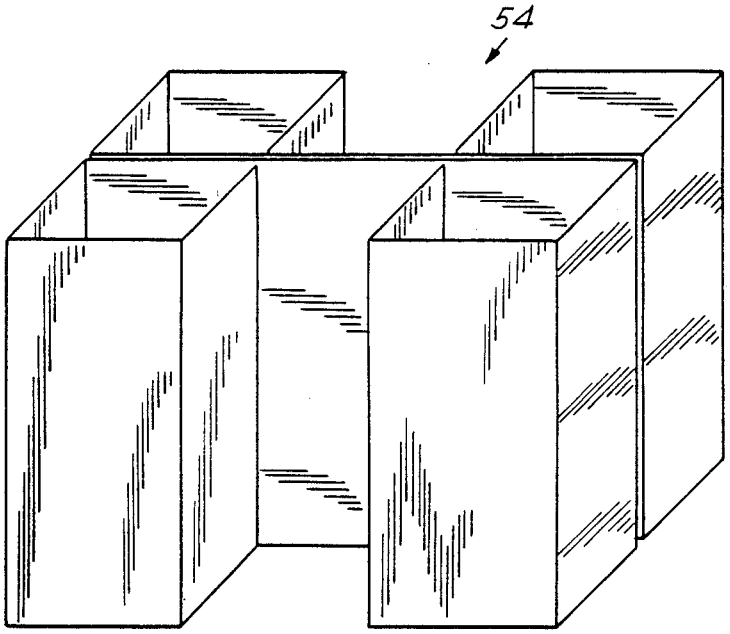
Figure 6:
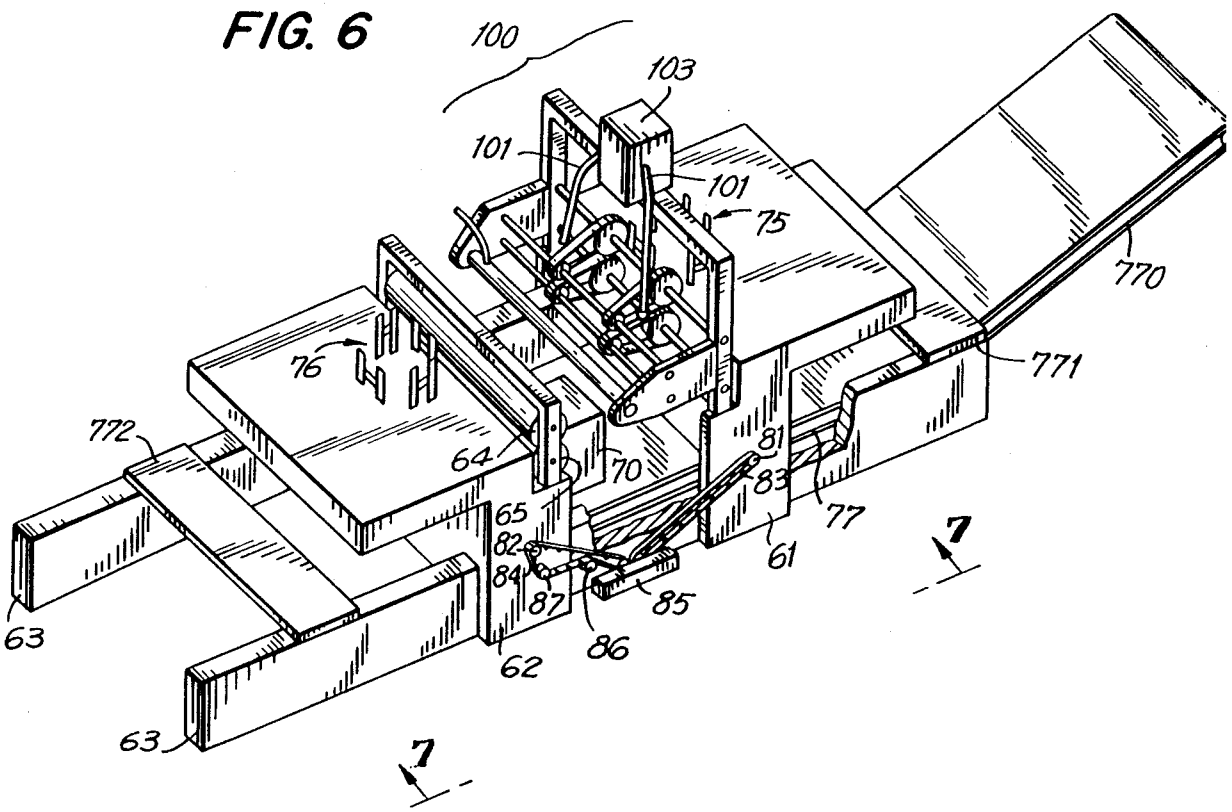
FIG. 6 is a perspective view of apparatus according to this invention for forming package inserts according to this invention.

Assembled insert 10, as shown in FIGS. 2–4, can be erected to assume the configuration in FIG. 1 by folding along score lines 14, 14', 15, 15'. The score patterns are preferably arranged, and blanks 11, 11' assembled, so that no score line has to be folded against its natural folding direction in erecting insert 10. The blanks are preferably scored using slitter-scorer equipment so that scores can be put into both sides if necesary to allow proper folding, although there may be applications where it is necessary or desirable to die-cut the blanks, in which case the ability to put score lines in both sides would be limited.

Erected insert 10 can be inserted into a carton or other container to form three compartments and to add vertical compressive strength in the direction indicated in FIG. 1 by double-ended arrow 20. Because the score patterns of both blanks 11, 11' are substantially identical, and because blanks 11, 11' are assembled with corresponding faces adjacent, insert 10, when erected, is rotationally symmetrical about an axis 21, which is parallel to the direction of compression, i.e., if erected insert 10 is rotated 180° about axis 21, it is indistinguishable from its initial orientation. If the score pattern were symmetrical about a centerline of blank 11 or 11' parallel to the direction of compression, the erected insert would additionally be symmetrical about a plane.

As discussed above, the compressive strength afforded by insert 10 is in part determined by the extent of adhesive areas 16, 17. It is also in part determined by the weight of board stock in blanks 11, 11'. It has been found that for the same weight of board stock and the same insert configuration, the insert of the present invention imparts up to 134% as much compresive strength as previously known inserts made of one blank folded on itself, adhered in some cases and not adhered in others. In fact, while blanks 11, 11' have been referred to as "substantially identical", with "substantially identical" score patterns, they are in the preferred embodiment actually the identical blank, one of which is rotated 180° so that corresponding faces are adjacent. However, it is possible to use two blanks of the same size with identical or substantially identical score patterns, but of different weights of board stock, in which case the blanks would only be substantially identical, to provide better control of the compressive strength than if (1) both blanks were of identical weight, or (2) a single blank were folded on itself providing two layers of identical weight as in the previously known inserts).

Alternative configurations of inserts according to this invention, other than the "Double-Z", are shown in FIGS. 5A–5E. All of these alternative configurations are assembled from blanks having a score pattern symmetrical about a blank axis parallel to the compression direction, and thus are symmetrical about a plane. Insert 50 is a type known in the art as a Facing Omega". Insert 51 is a type known in the art as an "H-Pad". Inserts 52–54 are variations of an "H-Pad" in which additional score lines are provided to form "wings" on the legs of the "H" which fold in one or the other direction. Insert 52 is also known as an "Opposing Omega", for reasons which are clear if it is compared to insert 50.

A preferred embodiment of apparatus 60 for assembling inserts according to the present invention is shown schematically in FIGS. 6–11. Blanks 11, 11' are formed off-line and loaded into apparatus 60, although it is possible to construct additional apparatus which will form the blanks and automatically load apparatus 60.

Apparatus 60 includes a first feeder 61 and a second feeder 62 mounted on rails 63. A receiving hopper 70, consisting of end walls 71, 72 and side guides 73, 74, is positioned between feeders 61, 62. Feeder 61 is fixed relative to rails 63. Feeder 62 is translatable along rails 63, and receiving hopper end wall 72 moves with it, so that the length of receiving hopper 70 (its dimension parallel to rails 63) can be adjusted. Receiving hopper side guides 73, 74 are also adjustable to select the width of receiving hopper 70. Each feeder 61, 62 has a respective feed hopper 75, 76 (shown schematically) into which the previously formed blanks 11, 11' are loaded. Completed inserts 10 are removed from the bottom of receiving hopper 70 by conveyor 77, which travels transversely to rails 63.

Blanks 11, 11' are loaded, respectively, into feed hoppers 75, 76. Preferably, there is actually only one type of blank which is loaded with a particular face up in feed hopper 75 and with the corresponding face down in feed hopper 76. Kicker plates 78, 79 are located at the bottom of each feed hopper 75, 76. Each kicker plate has a thickness less than that of a blank (if the blanks in the different feed hoppers differ in thickness, kicker plates 78, 79 may have to differ in thickness as well), and can reciprocate parallel to rails 63. As each kicker plate moves from behind its respective feed hopper, it pushes the blank at the bottom of the hopper toward the receiving hopper. The trailing edge of the kicker plate never exits from the end of the feed hopper closer to the receiving hopper, so that it stays below the remaining blanks in the feed hopper and is able to make the return stroke. The direction of movement of blanks 11, 11', parallel to rails 63, is the direction of compression of the finished insert 10.

Figure 7:
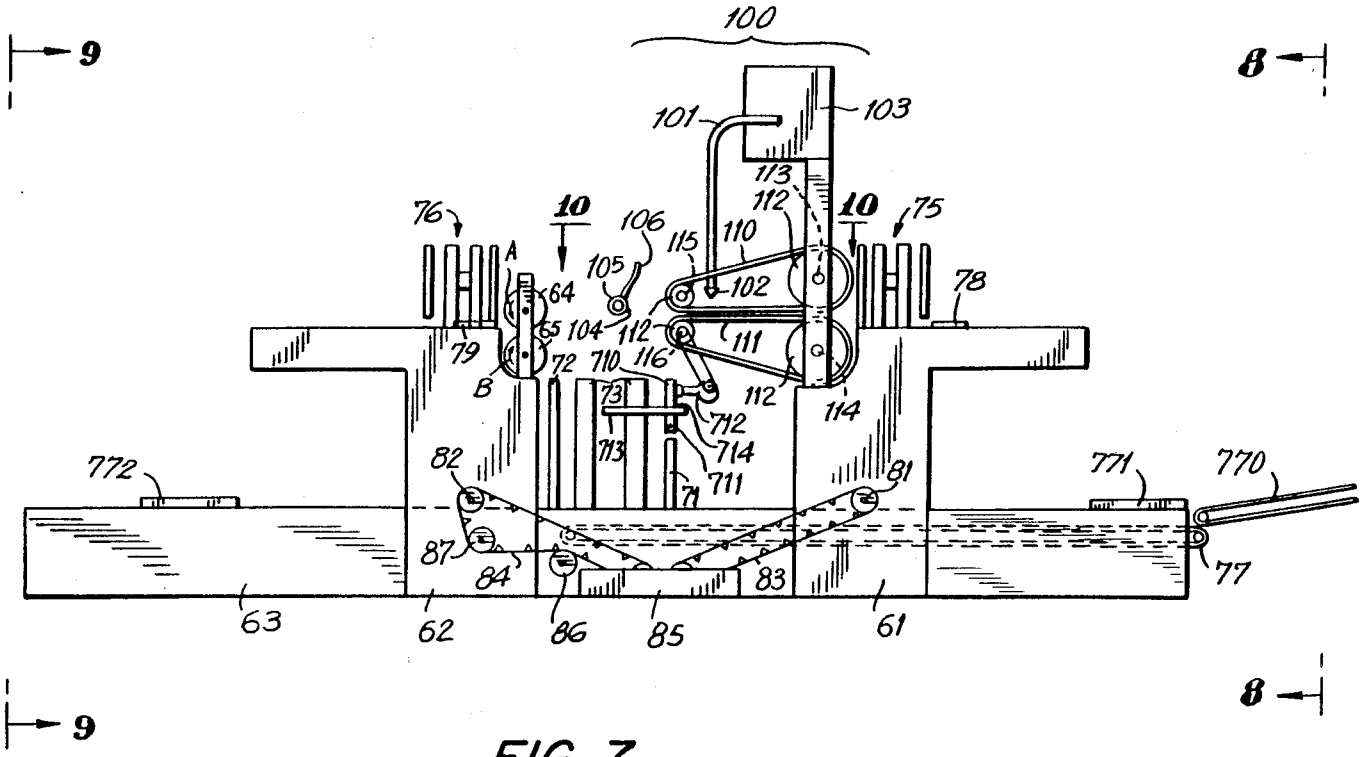
FIG. 7 is a side elevational view of the apparatus of FIG. 6, taken from line 7—7 of FIG. 6.

On second feeder 62, kicker plate 79 pushes blanks 11' out of feed hopper 76 into counter-rotating rollers 64, 65, which rotate in the directions shown by arrows A and B, respectively, in FIG. 7, accepting the blank 11' as it is ejected by kicker plate 79 and passing it at a controlled rate to receiving hopper 70.

On first feeder 61, however, after a blank 11 is pushed out of feed hopper 75, it must pass through adhesive applying area 100 so that adhesive can be applied to those areas to which it is desired that adhesive be applied. While the blank 11 passes through area 100 it must be under positive control so that the feed rate is constant. However, because adhesive is to be applied to the upper face of blank 11, rollers such as rollers 64, 65 which extend completely across blank 11 cannot be used, because they would (1) block access to blank 11 by the adhesive-applying elements, or (2) smear the adhesive after it is applied, or both. Therefore, blanks 11 are carried through adhesive-applying area 100 by a plurality of spaced apart sets of upper and lower belts 110, 111. Belts 110, 111 ride on a series of collars 112 on shafts 113–116. Collars 112 are translatable along shafts 113–116 so that the various sets of belts 110, 111 can be positioned to leave clear the areas of blank 11 that are to have adhesive applied, insofar as different adhesive patterns may be used for different types of inserts.

Adhesive is metered through adhesive lines 101 to adhesive heads 102 by a conventional adhesive metering system 103 such as the FLEXOSEAL ® Lap Gluing System sold by VALCO ® Cincinnati. The system can be adjusted to lay down a strip of adhesive along the direction of blank travel, which is also the direction of compression, starting at a particular point on blank 11 and ending at a particular point, such as starting at a predetermined distance from the leading edge and ending a predetermined distance from the trailing edge, based on the length of blank 11 and the speed of apparatus 60. The width of the strip of adhesive is determined by adhesive head 102. Preferably, adhesive head 102 has a plurality of spaced apart orifices to lay down a plurality of parallel beads of adhesive which merge together to fill the adhesive area of blank 11 when blank 11' is placed on top of it. The transverse positions of the adhesive areas are controlled by adjusting the positions of adhesive lines and heads 101, 102, which are adjustable.

Preferably, apparatus 60 includes some form of delay mechanism on (not shown) second feeder 62 so that, on start-up of apparatus 60, when receiving hopper 70 is initially empty, feeder 62 does not feed any blanks 11' until the first blank 11 has passed through adhesive applying section 100, so that a blank 11 having adhesive on it is the first blank in receiving hopper 70. Otherwise, a blank 11' will be wasted because the first blank 11 in receiving hopper 70 will have its side without adhesive toward the first blank 11'.

As blanks 11, 11' alternately feed into receiving hopper 70, they settle into receiving hopper 70 and adhere to one another, forming inserts 10. As they settle, the blanks are aligned by a spanker panel 710, which is the hinged upper portion of hopper wall 71, pivoted at 711 and driven back and forth by an eccentric drive 712 off shaft 116. As spanker panel 710 oscillates, it drives spring-loaded spanker arm 713, which bears against spanker panel 710 at 714. Spanker panel 710 and spanker arm 713 together spank two orthogonal sides of each blank 11, 11' as it falls, aligning the blanks. Although perfect alignment is desirable, it has been found that misalignment between a pair of blanks 11, 11' by as much as 3/16", and possibly more, has no measurable effect on the strength of insert 10.

By the time an insert 10 reaches the bottom of receiving hopper 70, the pressure of blanks and inserts above it for the period of its dwell in hopper 70 has set the adhesive sufficiently to allow removal of insert 10, although the period of dwell varies with the speed of apparatus 60, because the faster blanks are fed into receiving hopper 70, the faster inserts must be removed to make room for additional blanks. It has been found that apparatus 60 in the presently preferred embodiment can be operable at a rate of up to 22,000 inserts per hour, although the preferred operating range is 10,000 to 14,000 inserts per hour. The dwell time in receiving hopper 70 is dependent on the feed rate as well as on the height of hopper 70 and the thickness of each blank 11, 11 , because inserts must be removed as fast as blanks are fed to prevent overflow of receiving hopper 70. However, a minimum dwell time of 24 seconds is desirable for proper setting of the adhesive.

Take-away belt conveyor 77 removes inserts 10 from the bottom of receiving hopper 70 in a direction parallel to the direction in which they are fed into the hopper. Inserts 10 are removed under one of feeders 61, 62, and for that reason feeders 61, 62 are raised above the floor. Accordingly, operators' platforms 771, 772 are provided so that the operators can reach the feed hoppers 75, 76. Platform 772 must be able to move with feeder 62. The operator of one of feeders 61, 62 stands above conveyor 77. For convenience, in the preferred embodiment conveyor 77 passes under stationary feeder 61 and platform 771. However, it would also be possible to have conveyor 77 pass under movable feeder 62 and platform 772.

The rate of blanks fed is independent of their width in the preferred embodiment, because in the preferred embodiment feeders 61, 62 have a fixed feed stroke distance regardless of blank width. Conveyor 77 moves a continuous stream of abutting inserts 10 in a direction parallel to the feed direction, so that the rate of inserts removed does depend on their width. However, to prevent overflow of receiving hopper 70, the rate of inserts removed must always equal the rate of blanks fed by feeders 61, 62, so that the linear speed of conveyor 77 is related to the linear speed of kickers 78, 79 as the ratio of the width of blanks 11, 11' to the stroke distance of kickers 78, 79 which is fixed. A second conveyor 770, moving faster than conveyor 77, picks up inserts 10 from conveyor 77 and groups together a predetermined number of inserts 10 against a stop (not shown) from which they are periodically released for additional compression and banding.

Because blanks 11, 11' are being fed into receiving hopper 70 from two different directions at essentially the same time, care must be taken to assure that an orderly alternate feed by feeders 61, 62 is maintained, so that blanks 11, 11' are properly interleaved, without jamming or collisions. Two considerations apply to maintaining proper synchronization and orderly interleaving of blanks 11, 11' from the two feeders 61, 62. First, the movements of the two feeders 61, 62 must be maintained in synchronization. Second, the natural tendency of blanks 11, 11' to float slowly into receiving hopper 70 must be overcome so that a particular blank is not floating in the space into which the following blank is fed.

Figure 7A:
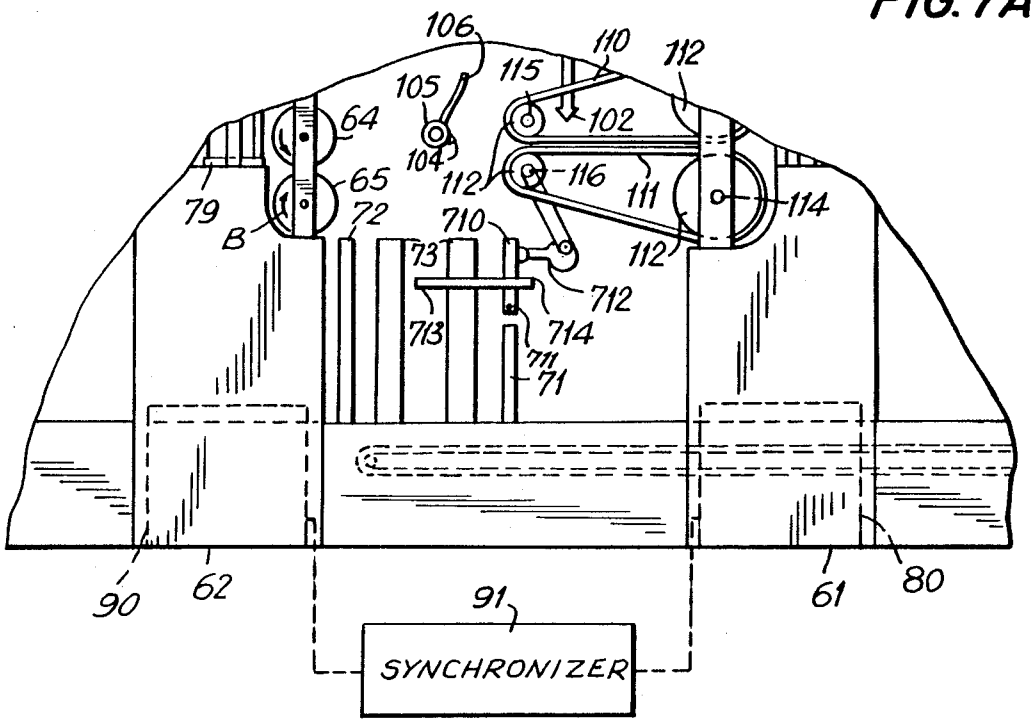
FIG. 7A is a fragmentary side elevational view of an alternate embodiment of the apparatus of FIG. 6, taken from line 7—7 of FIG. 6.
Figure 8:
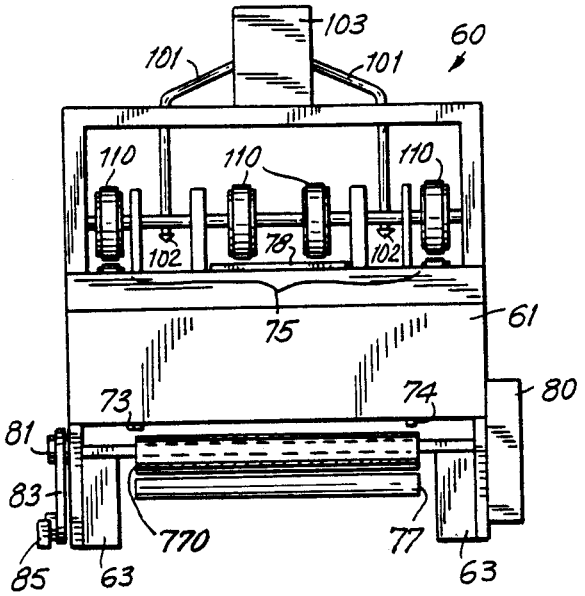
FIG. 8 is an end elevational view of the apparatus of FIG. 6, taken from line 8—8 of FIG. 7.
Figure 9:
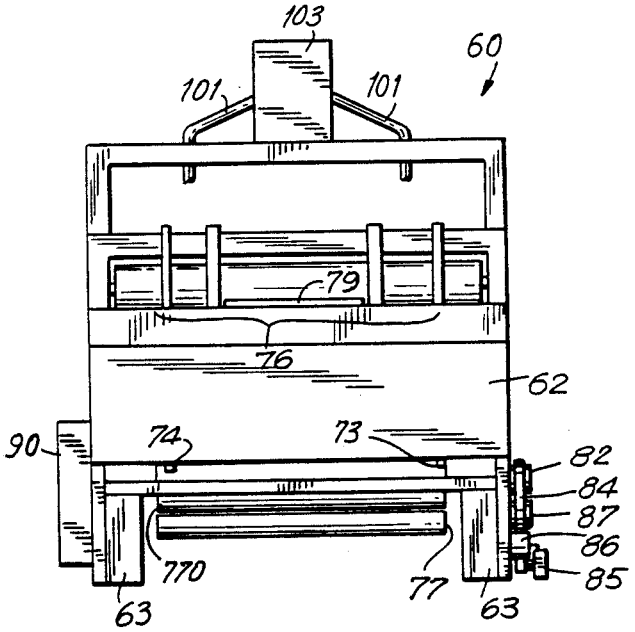
FIG. 9 is an end elevational view of the apparatus of FIG. 6, taken from line 9—9 of FIG. 7.
Figure 10:
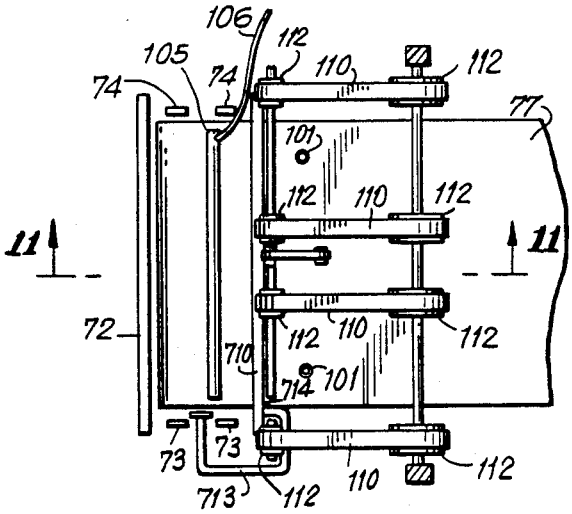
FIG. 10 is a plan view of the adhesive-applying section and the receiving hopper of the apparatus of FIG. 6, taken from line 10—10 of FIG. 7.
Figure 11:
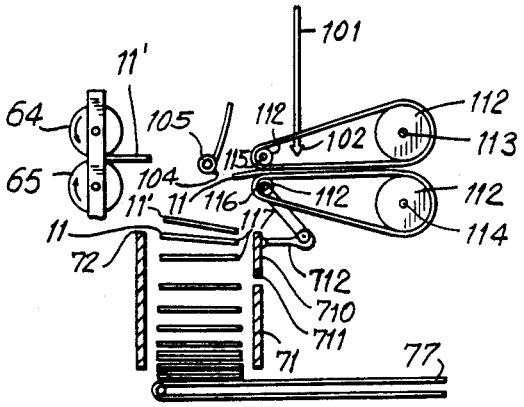
FIG. 11 is a vertical cross-sectional view of the adhesive-applying section of, the counter-rotating rollers of a feeder in, and the receiving hopper of, the apparatus of FIG. 6, taken from line 11—11 of FIG. 10, showing the feeding of blanks into, and the settling of blanks in, the receiving hopper.

In the illustrated embodiment, synchronization of feeders 61, 62 is accomplished mechanically. A single motor 80 drives feeder 61, which has a take-off cog-pulley 81. Feeder 62 has a drive cog-pulley 82 with the same number of teeth as cog-pulley 81. Each of cog-pulleys 81, 82 is connected by a respective cog-belt 83, 84 to a parallel-shaft drive reverser 85 having a 1:1 drive ratio, assuring that the two feeders 61, 62 are in synchronization. Thus the two kicker plates 78, 79 are seen to move in the same direction at the same time, so that while one is feeding, the other is on its return stroke. Because feeder 62 is movable along rails 63, cog-belt 84 must be long enough to accommodate the maximum separation between feeders 61, 62. Therefore, idler pulley 86 and idler cog-pulley 87 are provided on an adjustable idler arm (not shown) to take up the slack when feeders 61, 62 are separated by less than the maximum separation. Alternatively, feeder 62 could be provided with its own motor 90, and the two motors could be electronically interconnected by synchronization unit 91, as shown in FIG. 7A, so that they run in synchronization.

The settling of blanks 11, 11' in receiving hopper 70 is controlled in the preferred embodiment by air jets. It has been found that the amount of air must be carefully regulated. If too much air at too great a pressure is used, blanks 11, 11' are forced into vertical positions along the inside walls of receiving hopper 70. Even if less pressure is used, turbulence caused by the deflection of air off the surfaces of blanks already in receiving hopper 70 could actually prolong the floating of later-arriving blanks or otherwise cause blanks to collide with one another. In the preferred embodiment, a plurality of small air jets 104 are mounted on a bar 105 located above receiving hopper 70 and are connected by tube 106 to a supply (not shown) of air under pressure. Air is directed under pressure from nozzles 104 toward receiving hopper 70. In the preferred embodiment, nozzles 104 are angled approximately 10° from the vertical toward spanker panel 710, which preferably is slatted to allow air to disperse from receiving hopper 70. The pressure is low enough not to cause turbulence or to force the banks down with too much force, but it is sufficient to force edge 117 of a blank 11, 11' down enough to prevent a collision between that blank and the next blank, and is determined empirically based on the size of the blank.

Thus it is seen that a multiple layer insert which can be erected by automatic insert erecting machinery and is stronger than previous multiple layer inserts for the same grade of board stock is provided, as well as a method and apparatus for forming the insert. One skilled in the art will appreciate that the present invention can be practiced by other than the described embodiments, which are presented for purposes of illustration and not of limitation, and the present invention is limited only by the claims which follow.

What is claimed is:

1. Apparatus for forming a laminated package insert from two substantially identical blanks, each of said blanks having a substantially identical score pattern, by adhesively assembling one of a first and second face of one of said blanks to the corresponding one of a first and second face of the other of said blanks, said insert being for providing compressive strength in a desired direction to a package in which it is inserted, said apparatus comprising:

a receiving hopper for receiving said blanks with their corresponding faces adjacent one another;

first feeding means on a first side of said receiving hopper for feeding a series of first blanks in rapid succession into said receiving hopper from said first side with one of said first and second faces up;

second feeding means on a second side of said receiving hopper directly opposite said first feeding means for feeding a series of second blanks into said receiving hopper from said second side with a corresponding one of said first and second faces down;

adhesive-applying means associated with said first feeding means for applying adhesive to at least one selected area of said one of said first and second faces of each of said first blanks fed by said one of said first feeding means, each of said second blanks fed by said second feeding means remaining free of adhesive until it contacts one of said first blanks, said at least one selected area extending substantially from a first end of each of said first blanks to a second end of each of said first blanks in said desired direction, said at least one area extending over less than the full extent of each of said first blanks in a direction normal to said desired direction, leaving at least one adhesive-free area on each of said first blanks, before feeding each of said first blanks to said receiving hopper;

synchronization means interconnecting said first and second feeding means for controlling the feeding of said blanks to said receiving hopper such that said first and second feeding means alternately feed blanks at the same feed rate to said receiving hopper from alternate sides of said receiving hopper;

settling controlling means associated with said receiving hopper for causing each of said blanks to settle by free fall in said receiving hopper, without excessive float and substantially without turbulence, at a settling rate sufficient to prevent collisions between blanks fed by said first feeding means and blanks fed by said second feeding means, such that each of said first blanks to which adhesive has been applied by said adhesive-applying means adheres in said receiving hopper to an adjacent second blank which is free of adhesive to form said laminated package insert; and take-away means for removing said inserts from said receiving hopper; whereby:

each of said inserts can be erected by folding said adhered blanks in accordance with said score pattern, said first and second blanks separating in at least one adhesive-free area, but remaining adhered in said at least one area of adhesive, upon erection of said insert.

2. The apparatus of claim 1 wherein:

said first and second feeding means share a common drive, said common drive directly driving one of said feeding means at a given rate; and said synchronization means comprises a mechanical linkage between said first and second feeding means for driving the other of said feeding means at said given rate.

3. The apparatus of claim 2 wherein said mechanical linkage comprises a gear-and-belt arrangement having a 1:1 ratio.

4. The apparatus of claim 1 wherein:

each of said first and second feeding means is driven by a separate drive; and said synchronization means comprises electronic means for causing said separate drives to drive said first and second feeding means at the same rate.

5. The apparatus of claim 1 wherein:

said adhesive-applying means is associated with said first feeding means;

said one of said faces to which adhesive is applied faces up; and both of said first and second feeding means comprise:

a respective feed hopper into which said blanks are loaded, said blanks being loaded into the feed hopper of said first feeding means with said one of said faces facing up and being loaded into the feed hopper of said second feeding means with said one of said faces facing down, and ejection means for ejecting said blanks from said feed hoppers for feeding into said receiving hopper.

6. The apparatus of claim 5 wherein:

said second feeding means comprises upper and lower rollers for feeding said ejected blanks into said receiving hopper; and said first feeding means comprises upper and lower belts for carrying said blanks through said adhesive-applying means, said belts being spaced apart in a direction normal to said desired direction for allowing said adhesive-applying means to apply adhesive in said desired direction.

7. The apparatus of claim 6 wherein said belts are translatable in said normal direction for accommodating the application of any desired pattern of adhesive by said adhesive-applying means.

8. The apparatus of claim 6 further comprising delay means for delaying, on start-up of said apparatus, the ejection of blanks from said second feed hopper for a delay period sufficient for a first blank ejected from said first feed hopper to transit said adhesive-applying means.

9. The apparatus of claim 1 wherein said settling controlling means comprises means for directing air under pressure and substantially without turbulence downward into said receiving hopper, such that blanks received in said hopper from one of said feeding means settle without excessive float to prevent collision with the next blank received from the other of said feeding means.

10. The apparatus of claim 9 wherein said air directing means comprises a plurality of air jets above said receiving hopper.

11. The apparatus of claim 1 wherein said take-away means removes inserts from said receiving hopper from a third side of said receiving hopper.

12. The apparatus of claim 1 wherein said receiving hopper comprises means for aligning said blanks as they settle into said hopper.

13. The apparatus of claim 12 wherein said blank-aligning means comprises at least one spanker panel.

14. The apparatus of claim 13 wherein at least a portion of one side of said receiving hopper serves as said spanker panel.

15. A method for forming a laminated package insert from two substantially identical blanks, each of said blanks having a substantially identical score pattern, by adhesively assembling one of a first and second face of one of said blanks to the corresponding one of a first and second face of the other of said blanks, said insert being for providing compressive strength in a desired direction to a package in which it is inserted, said method comprising the steps of:

providing a receiving hopper for receiving said blanks with their corresponding faces adjacent one another;

feeding a series of first blanks in rapid succession into said receiving hopper from a first side of said receiving hopper with one of said first and second faces up;

feeding a series of second blanks in rapid succession from a second side of said receiving hopper directly opposite said first side into said receiving hopper with a corresponding one of said first and second faces down;

applying adhesive to at least one selected area of said one of said first and second faces of each of said first blanks fed into said receiving hopper, each of said second blanks remaining free of adhesive until it contacts said one of said first blanks, said at least one selected area extending substantially from a first end of each of said first blanks to a second end of each of said first blanks in said desired direction, said at least one area extending over less than the full extent of each of said first blanks in a direction normal to said desired direction, leaving at least one adhesive-free area on each of said first blanks, before feeding each of said first blanks to said receiving hopper;

controlling the feeding of said blanks to said receiving hopper such that blanks are alternately fed from said first and second sides at the same feed rate to said receiving hopper from alternate sides of said receiving hopper;

controlling the settling of each of said blanks for causing each of said blanks to settle by free fall in said receiving hopper, without excessive float and substantially without turbulence, at a settling rate sufficient to prevent collisions between blanks fed from said first side and blanks fed from said second side, such that each of said first blanks to which adhesive has been applied adheres in said receiving hopper to an adjacent second blank which is free of adhesive to form said laminated package insert; and removing said inserts from said receiving hopper; whereby:

each of said inserts can be erected by folding said adhered blanks in accordance with said score pattern, said first and second blanks separating in at least one adhesive-free area, but remaining adhered in said at least one area of adhesive, upon erection of said insert.

16. The method of claim 15 further comprising:

synchronizing the feeding of blanks from said first and second sides of said receiving hopper at said given rate to prevent collisions between blanks fed from said first side and blanks fed from said second side.

17. The method of claim 15 wherein said adhesive is applied to said first blank, said one of said faces to which adhesive is applied facing up.

18. The method of claim 15 further comprising delaying, on beginning performance of said method, the feeding of said second blanks for a delay period sufficient to allow for the application of adhesive to a first one of said first blanks.

19. The method of claim 15 further comprising directing air under pressure and substantially without turbulence downward into said receiving hopper, such that blanks fed into said hopper from one of said sides settle without excessive float to prevent collision with the next blank received from the other of said sides.

20. The method of claim 15 wherein said takeaway step comprises removing inserts from said receiving hopper from a third side of said receiving hopper.

21. The method of claim 15 further comprising aligning said blanks as they settle into said hopper.

* * * * *

UNITED STATES PATENT AND TRADEMARK OFFICE

CERTIFICATE OF CORRECTION

PATENT NO. : 4,850,948

DATED : July 25, 1989

INVENTOR(S) : Ronald F. Schmitz

It is certified that error appears in the above-identified patent and that said Letters Patent is hereby corrected as shown below:

Column 1, line 51, "bank" should be -- blank --.

Column 2, line 36, "on" should be -- in --.

Column 5, line 5, "as" should be -- (as --;

line 12, "Facing" should be -- "Facing --.

Column 7, line 8, "11 ," should be -- 11', --.

Signed and Sealed this

Thirtieth Day of July, 1991

*Attest:*

*Attesting Officer*

HARRY F. MANBECK, JR.

*Commissioner of Patents and Trademarks*